US010697172B2

(12) United States Patent
De Almeida Borges

(10) Patent No.: US 10,697,172 B2
(45) Date of Patent: Jun. 30, 2020

(54) SHIELD REINFORCEMENT PLATE

(71) Applicant: Carlos Alberto De Almeida Borges, Rio de Janeiro (BR)

(72) Inventor: Carlos Alberto De Almeida Borges, Rio de Janeiro (BR)

( * ) Notice: Subject to any disclaimer, the term of this patent is extended or adjusted under 35 U.S.C. 154(b) by 0 days.

(21) Appl. No.: 16/209,177

(22) Filed: Dec. 4, 2018

(65) Prior Publication Data

US 2019/0177965 A1 Jun. 13, 2019

(30) Foreign Application Priority Data

Dec. 7, 2017 (BR) ..... BR1020170263940

(51) Int. Cl.

| | |
|---|---|
| ***E04B 1/41*** | (2006.01) |
| ***E04C 3/08*** | (2006.01) |
| ***E04B 7/02*** | (2006.01) |
| *E04C 3/04* | (2006.01) |

(52) U.S. Cl.

CPC ..... *E04B 1/40* (2013.01); *E04B 7/022* (2013.01); *E04C 3/08* (2013.01); *E04C 2003/0491* (2013.01)

(58) Field of Classification Search

CPC ... E04B 1/18; E04B 1/215; E04B 1/24; E04B 1/40; E04B 7/022; E04C 3/08; E04C 2003/0491

See application file for complete search history.

(56) References Cited

U.S. PATENT DOCUMENTS

| | | | | | |
|---|---|---|---|---|---|
| 2,152,189 | A * | 3/1939 | Henderson | E04B 1/24 | 52/693 |
| 2,284,898 | A * | 6/1942 | Hartman | E04B 1/19 | 52/654.1 |
| 2,514,607 | A * | 7/1950 | McLean | E01D 6/00 | 52/692 |
| 3,152,671 | A * | 10/1964 | Mallory, Jr. | E01D 6/00 | 52/654.1 |
| 3,336,717 | A * | 8/1967 | Ward, Jr. | E04B 7/00 | 52/645 |
| 3,826,057 | A * | 7/1974 | Franklin | E04C 3/08 | 52/641 |
| 3,857,218 | A * | 12/1974 | Gilb | E04C 3/292 | 52/694 |

(Continued)

FOREIGN PATENT DOCUMENTS

| | | |
|---|---|---|
| BR | PI 7805402-8 | 8/1978 |
| BR | PI 8504326-5 | 4/1987 |

(Continued)

OTHER PUBLICATIONS

Brazilian Standard, NBR 14762, "Dimensionamento de Estruturas de Ace Constituidas por Perlis Formados a Frio—Design of Cold-Formed Steel Structures", Associacao Basileira de Normas Tecnicas, ABNT 2010, pp. 1-93 with English Translation of relevant pp. 65-68.

*Primary Examiner* — James M Ference
(74) *Attorney, Agent, or Firm* — Pearne & Gordon LLP

(57) ABSTRACT

A shield reinforcement plate including a steel plate of approximately 1 to 3 mm thick, shaped in characteristic form by a tool in a continuous process. The shield reinforcement plate including 2 (two) holes, a pair of fins, also referred to as flaps and a fold at 90° relative to a base of the shield reinforcement plate. The fold referred to as a stiffener.

3 Claims, 15 Drawing Sheets

(56) References Cited

U.S. PATENT DOCUMENTS 3,966,164 A * 6/1976 Dashew ..... E04G 11/48 249/18
3,977,536 A * 8/1976 Moore ..... E04G 19/003 414/11
4,003,179 A * 1/1977 Gilb ..... E04B 1/2608 52/696
4,050,210 A * 9/1977 Gilb ..... E04C 3/292 52/639
4,077,176 A * 3/1978 Bauer ..... E04C 3/292 52/692
4,569,501 A * 2/1986 McCracken ..... E04G 11/52 249/18
4,585,204 A * 4/1986 Parker ..... E04G 11/40 249/27
4,790,113 A * 12/1988 Gregory ..... E04G 11/38 249/28
4,831,797 A * 5/1989 Vladikovic ..... E04G 11/38 52/126.6
4,833,844 A * 5/1989 Wiklund ..... E04B 7/08 52/533
4,862,662 A * 9/1989 Eberle ..... E04B 5/12 52/299
5,251,412 A * 10/1993 de Almeida Borges ..... E04B 7/00 52/109
5,273,415 A * 12/1993 Jackson ..... E04G 19/003 248/163.1
5,390,460 A * 2/1995 Llorens ..... E04B 7/20 52/489.1
5,651,229 A * 7/1997 Wada ..... E04B 2/96 52/204.2
5,660,017 A * 8/1997 Houghton ..... E04B 1/2403 52/167.3
5,857,306 A * 1/1999 Pellock ..... E04B 1/5806 403/230
6,138,427 A * 10/2000 Houghton ..... E04B 1/2403 52/236.3
6,892,502 B1 * 5/2005 Hubbell ..... E04C 3/08 40/584
6,928,782 B2 * 8/2005 Becker ..... E04B 5/10 52/693
8,056,291 B1 * 11/2011 diGirolamo ..... E04B 5/19 52/250
8,146,322 B2 * 4/2012 Karns ..... E04B 1/2403 52/653.1
8,881,486 B2 * 11/2014 Robinson ..... E04C 3/02 52/692
10,190,308 B2 1/2019 De Almeida Borges
2005/0204684 A1 * 9/2005 Houghton ..... E04B 1/24 52/653.1
2006/0053732 A1 * 3/2006 Watson ..... E04C 3/09 52/693
2010/0044524 A1 * 2/2010 Sugaya ..... F16B 33/002 248/49
2010/0086348 A1 * 4/2010 Funahashi ..... H02G 3/0456 403/306
2011/0203217 A1 * 8/2011 Dayton ..... E04B 1/24 52/705
2013/0042568 A1 * 2/2013 Davis ..... E04B 1/24 52/634
2013/0283728 A1 * 10/2013 Chang ..... E04C 3/02 52/846
2014/0075875 A1 * 3/2014 Dayton ..... E04B 1/1903 52/655.1
2016/0298333 A1 * 10/2016 Hsieh ..... E04B 5/40
2018/0155918 A1 * 6/2018 De Almeida Borges ..... E04C 3/09
2019/0177965 A1 * 6/2019 De Almeida Borges ..... E04C 3/08

FOREIGN PATENT DOCUMENTS

BR PI 9100456-0 9/1992
BR PI 9304495-0 7/1995
BR PI 9601145-9 1/1998
BR PI 0902183-3 12/2010
BR 102016014526-0 1/2018
WO 2011116437 9/2011
WO 2017219104 12/2017

* cited by examiner

SHIELD REINFORCEMENT PLATE

SUMMARY OF THE INVENTION

The present invention relates to the application of reinforcement devices in the connections in a metal cover to support loads higher than the connections are resistant by themselves.

BACKGROUND OF THE INVENTION

The device of the present invention directly derives and complements several inventions owned by applicant, the first configuration having been filed with Brazilian Patent Office Aug. 21, 1978 (PI 7805402-8), the second one on Sep. 9, 1985 (PI 8504326-5), the third one on Feb. 2, 1991 (PI 9100456-0), the fourth one on Nov. 5, 1993 (PI 9304495-0), the fifth one on Mar. 27, 1996 (PI 9601145-9), the sixth one on Mar. 23, 2009 (PI 0902183-3), and the last one on Jun. 20, 2016 (BR102016014526-0).

The first configuration (basic structure) is defined by parts 1—Upper/Lower Chord, parts 11—Diagonals of a Frame, parts 12—Bridging angles of the Frame, parts 15—Roof Coils (tiles), parts 8—Cover plate (See, FIG. 1A).

From its launch to the present days, the system initially revealed, described above, has about 10 million square meters installed, meeting all the demands and technical requirements requested by the market.

However, there have been changes in the needs imposed by the coverage market, which requires product adaptation. Thus, nowadays, the product is often used for purposes or in conditions different from those used as a basis for its development. One of the changes concerns the overload imposed on the coverage, that is, there is a need today to use this coverage system with a payload greater than the one initially assigned to the coverage. The coverage of a mall, for example, should support loads of plaster lining, electricity pipe rack, sprinkler distribution network, sound reinforcement network, air conditioning etc.

As a result, the structure is limited by the capacity of the connections between its parts. In the case of the initially disclosed system, its structure is composed of lattice girder beams, with bolted connections between the parts: chord (1) and diagonal (11).

For the sizing of these connections, the resistance of a screw to cutting (FIG. 5A), the crushing of a hole (FIG. 5B) and longitudinal (FIG. 5C) and transverse tears of the connected plates are considered.

To increase the resistance of the bolt to cutting one can use special steel alloys or increase a diameter of the bolt.

In the case of a sheet metal, the increase in its resistance to the cited effects—crushing of hole or tears—is due to the increase in its thickness, which causes the entire piece to be very heavy, increasing the cost as a whole. The increase in thickness does not apply to parts or sections of the plate, but to its full extent, making it impracticable to reinforce this or that point increasing the thickness.

BRIEF SUMMARY OF THE INVENTION

Thus, the present invention provides a piece which only reinforces an area of a connection, called a shield (9). The piece allows for keeping the thickness of the plate forming a chord (1) unchanged. Accordingly, the chord (1) continues to have the standard thickness, having its shields (9) reinforced when necessary. This piece is called Shield Reinforcement Plate (20), shown in FIGS. 1B and 1C.

A second shield reinforcement plate model (21) shown in FIGS. 2A, 2B and 2C was the result of theoretical studies and many assays. In the initial tests it was found that due to the tensile and compression stresses of diagonals (11) connecting to a shield (9), a reinforcement placed thereon and connected to the shield (9) through holes of diameter and distance therebetween equal to the shield (9*a*, 9*b*, 21*a*, 21*b*), as shown in FIGS. 4A, 4B, 4C, 2C, connected with the same screws that connect the chord to the diagonals, there is a tendency for rotational movement of the connection. To hinder this rotation, the shield reinforcement plate was provided with 90° flaps (21*d*) and holes (21*c*), to be fixed to the chord by a self-drilling screw.

The inherent difficulties of installation caused a first preferred embodiment of the shield reinforcement plate (20) to be developed, as shown in FIGS. 1A, 1B and 1C. In this first embodiment, the shield reinforcement plate (20) is formed by a galvanized steel plate, preferably of the same thickness as the chord. The shield reinforcement plate (20) does not have fastening flaps with screws for preventing rotation, but only two holes (20*a* and 20B) for its fastening with screws and two small flaps (20*d*) inclined relative to the chord, as shown in FIGS. 3A, 3B, 3C, 3D, 3E, and 3F. The two small flaps (20*d*) are introduced into grooves (RE) in a chord, specifically made for this purpose (FIGS. 4B, 4C and 4D).

DESCRIPTION OF FIGURES

FIGS. 3A, 3B, 3C, 3D, 3E, and 3F are various views of the first embodiment of the shield reinforcement plate (20) illustrated in FIG. 1C, wherein:

FIGS. 3A, and 3B are perspective views showing fastening holes (20*a*, 20*b*), small and slanted flaps (20*d*), with recesses (20*e*) in a base of the flap (20) near fold lines of the flaps (20*f*), the recesses (20*e*) positioned to be introduced into specific grooves in chords (not shown) and a stiffener (20*c*) in a base of the shield reinforcement plate (20) that is folded 90° relative to a fold line (20*h*) along a longitudinal direction of the base of the shield reinforcement plate (20);

FIGS. 3C, 3D, and 3E are top, front and side views, respectively, of the first embodiment of the shield reinforcement plate of FIGS. 3A and 3B; and FIG. 3F illustrates the first embodiment of the shield reinforcement plate shown in FIGS. 3A and 3B after the shield reinforcement plate has been cut but before the shield reinforcement plate has been folded along folds (20*f*, and 20*h*), showing the relative position of holes (20*a*, 20*b*), the fold line (20*h*) for forming 90° folds for stiffening part (20*c*) and the fold lines (20*f*) for forming at 90° the flaps (20*d*) with their recesses (20*e*), wherein as shown in FIGS. 3A to 3E, the flaps (20*d*) are folded in a direction that is opposite to direction that the stiffener (20) is folded;

FIGS. 4A, 4B, 4C, and 4D illustrate a development or formation of the chord part (1), wherein:

FIG. 4A is a flat development view of the chord part (1) of the initially disclosed system structure of FIG. 1A, with shield fins (9) and respective holes (9*a*, 9*b*);

FIG. 4B, compared to FIG. 4A, is a flat development view of the chord part (1) of the initially disclosed system structure of FIG. 4A modified for installation of the shield reinforcement plate of the present invention, showing around each shield (9) there are holes (9*a*, 9*b*) and grooves (RE) into which the flaps (20*d*) of the shield reinforcement plate will be inserted;

FIG. 4C is a perspective view of a formed chord (1) of FIG. 4B of the structure for the coverage in which the present invention will be installed, where it can be seen just below each shield (9) the grooves (RE) in which the shield reinforcement plate flaps (20*d*) will be inserted; and FIG. 4D is a side view of the formed chord (1) of FIG. 4C of the structure for the coverage in which the present invention will be installed, showing just below each shield (9) the grooves (RE) in which the flaps (20*d*) of the shield reinforcement plate will be inserted;

FIGS. 5A, 5B, and 5C are perspective views of a connection of two diagonals (11) to a shield (9) of the chord (1) of a beam of the coverage structure, wherein:

FIG. 5A is a perspective view of a connection of two diagonals (11) to a shield (9) of the chord (1) of a beam of the coverage structure, illustrating the rupture of bolts, due to the action of a supposed critical load, with a stress vector and illustrating a movement of the diagonal (11) upwards with a head section of the fastening bolt thereof in the chord;

FIG. 5B is a perspective view of a connection of two diagonals (11) to a shield (9) of the chord (1) of a beam of the coverage structure, illustrating the crushing of a shield hole (9) due to the action of a supposed critical load, with stress vector; and FIG. 5C is a perspective view of a connection of two diagonals (11) to a shield (9) of the chord of a beam of the coverage structure, emphasizing the tearing of a shield plate due to the action of a supposed critical load in sequence to the crushing shown in FIG. 5B, with stress vector;

BRIEF DESCRIPTION OF THE INVENTION

Figure 1A:
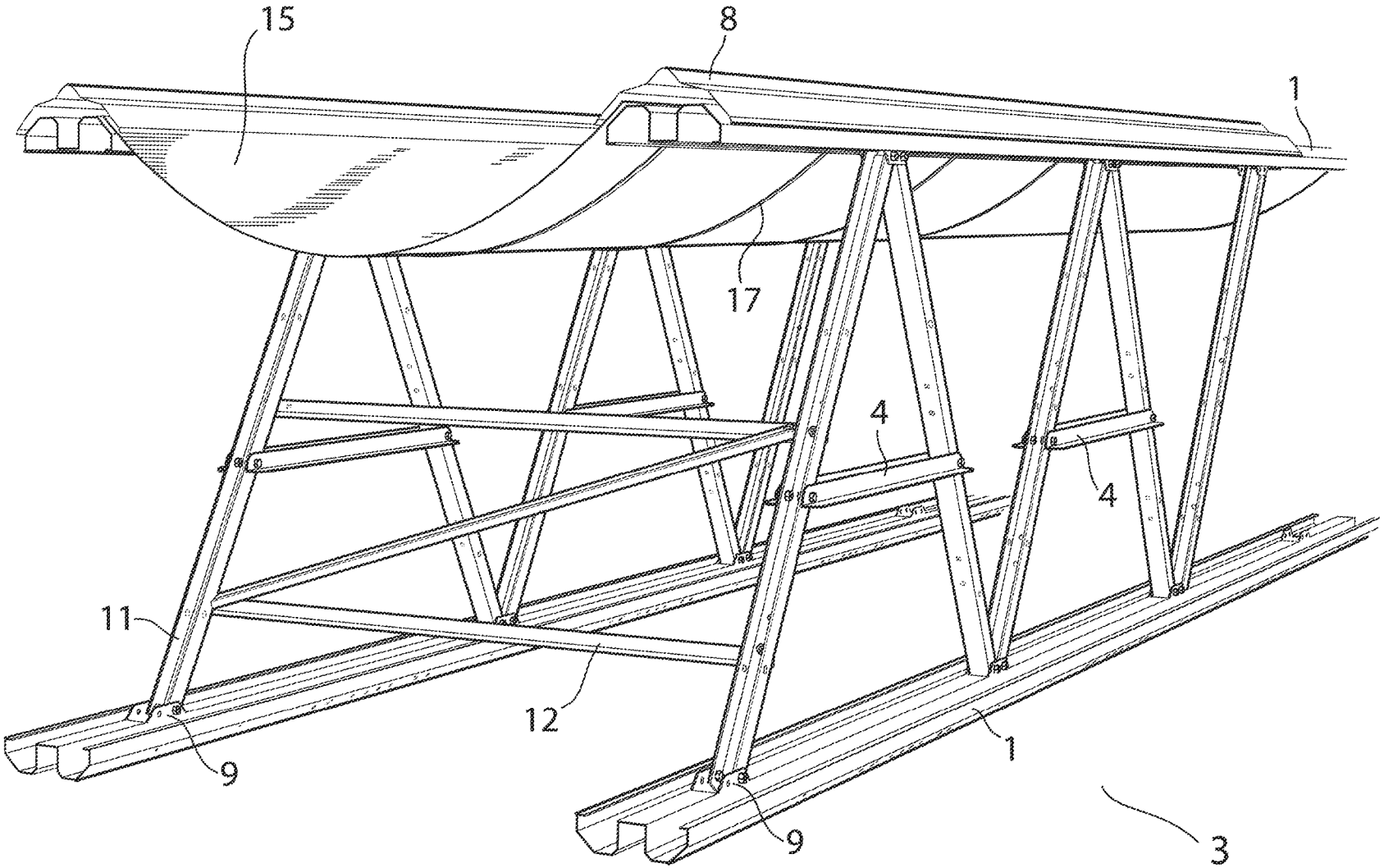
FIG. 1A is a perspective view of a coverage structure of an initially disclosed system (3), showing a chord (1), diagonals (11), bridging angles (12), a cover plate (8), a roof coil (tile/coverage) (15), a diagonal brace (4), and shields (9)

The present invention basically comprises an embodiment of a shield reinforcement plate (20) and a second embodiment of a shield reinforcement plate (21) applied to a specific coverage system (3).

It can be considered in the calculation as if the shield were made by a plate with twice the thickness. In the case of the standard chord, with a thickness of 1.55 mm, the shield is in practice as if it were 3.10 mm thick. In this case, the weak point becomes the diagonal, which remains with 1.55 mm. Therefore, when using the shield reinforcement plate, one should change the diagonal, usually with a thickness of 1.55 mm, for another with a thickness of 1.95 mm or, in cases of greater stress, 2.70 mm.

Figure 1B:
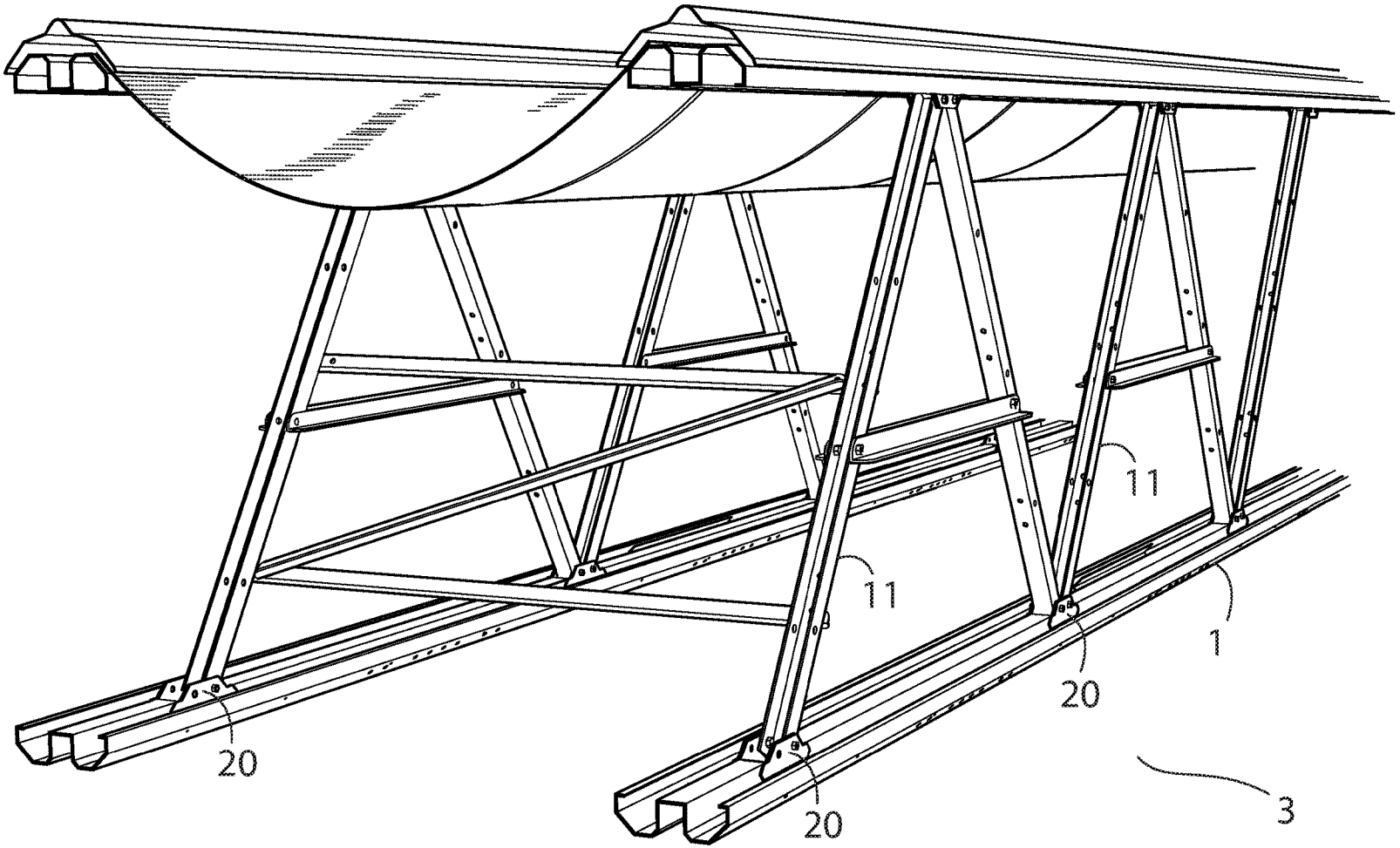
FIG. 1B is a perspective view similar to FIG. 1A but illustrating a first embodiment of a shield reinforcement plate (20) installed in beams.
Figure 1C:
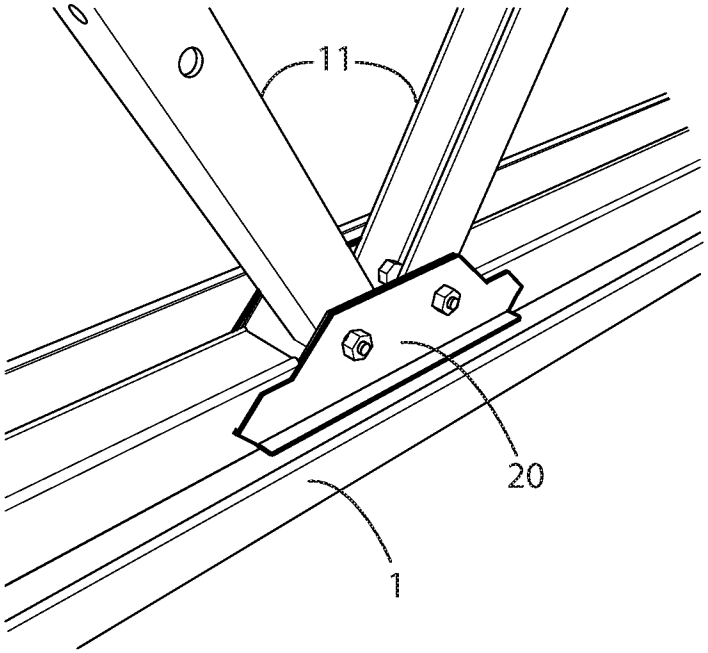
FIG. 1C is an enlarged view of the shield reinforcement plate (20) shown in FIG. 1B.
Figure 2A:
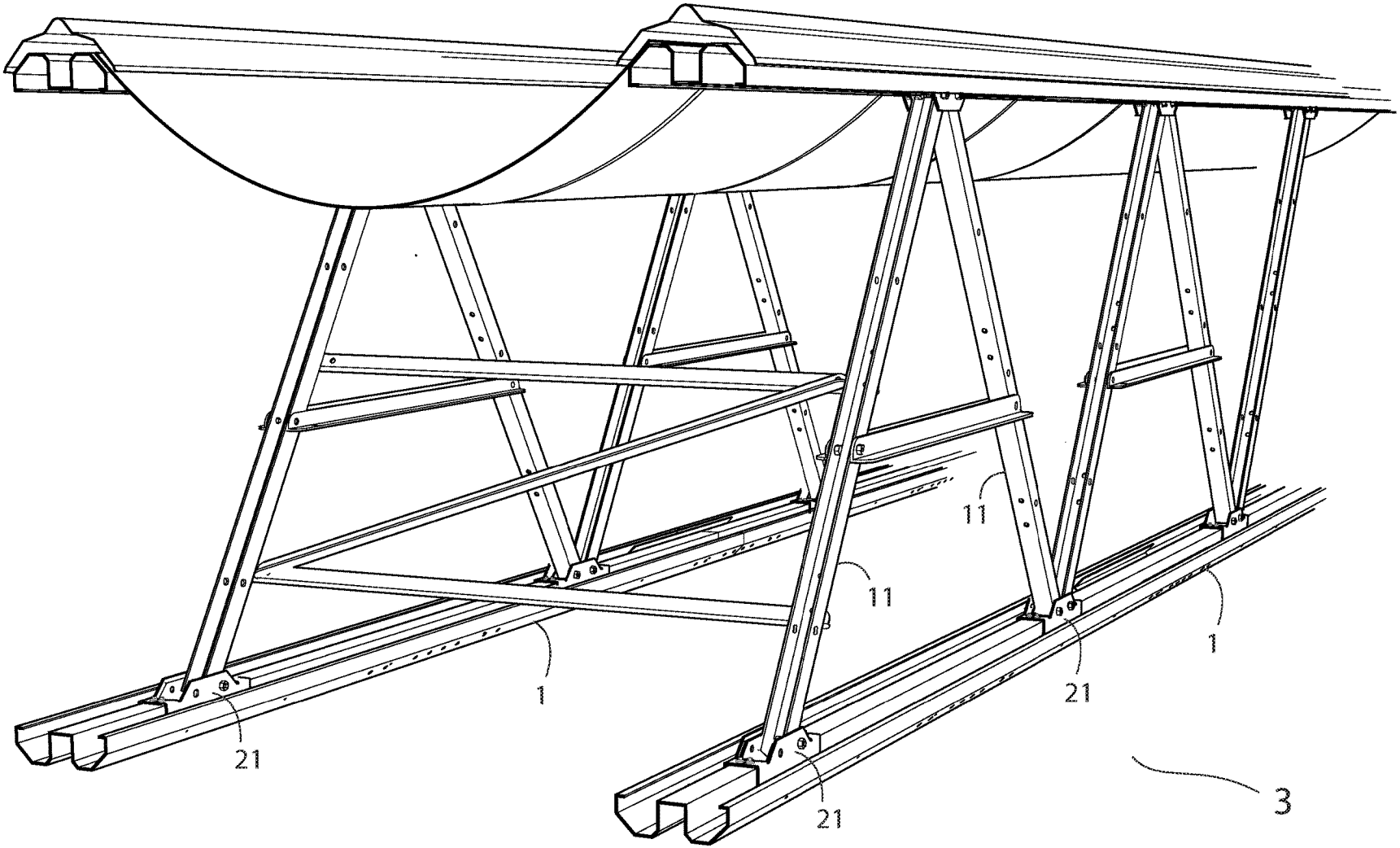
FIG. 2A is a perspective view of a cover structure of a system (3), with a second embodiment of a shield reinforcement plate (21) installed in beams.
Figure 2C:
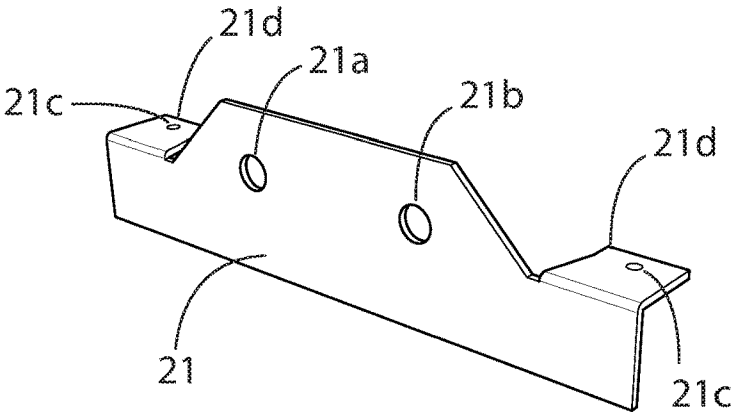
FIG. 2C is a perspective view of the second embodiment of the shield reinforcement plate (21) illustrated in FIG. 2B showing fastening holes (21*a*, 21*b*), and flaps (21*d*) with holes (21*c*) for receiving self-drilling screws (not shown)
Figure 2B:
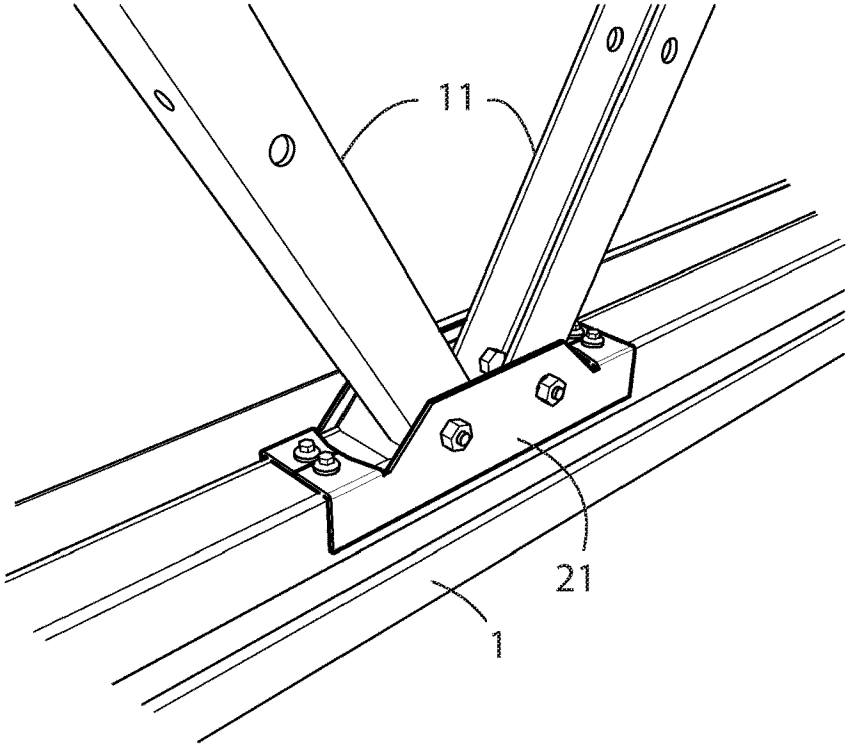
FIG. 2B is an enlarged perspective view of the second embodiment of the shield reinforcement plate (21) shown in FIG. 2A.
Figure 3B:
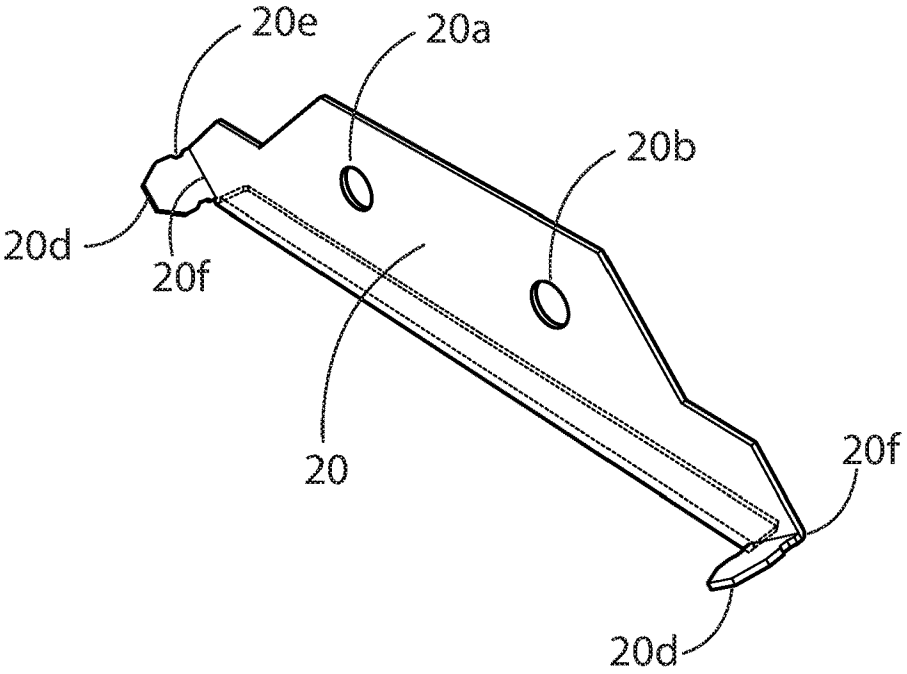
Figure 3A:
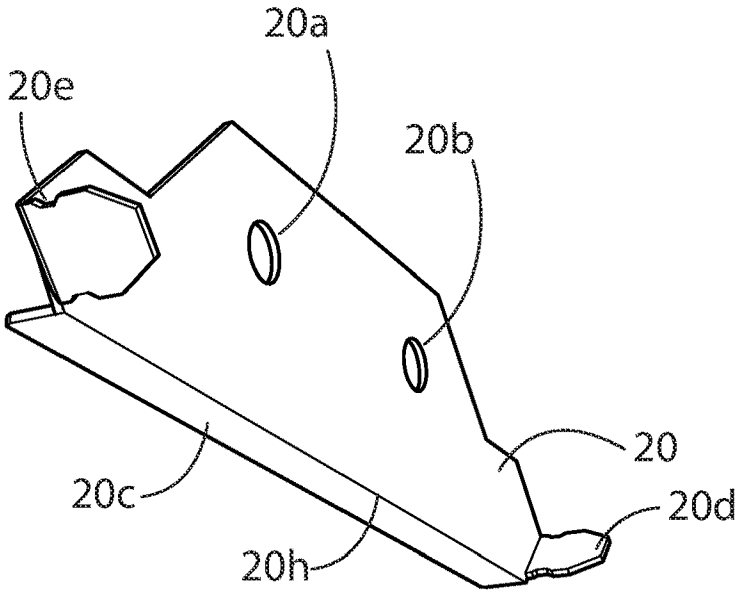
Figure 3C:
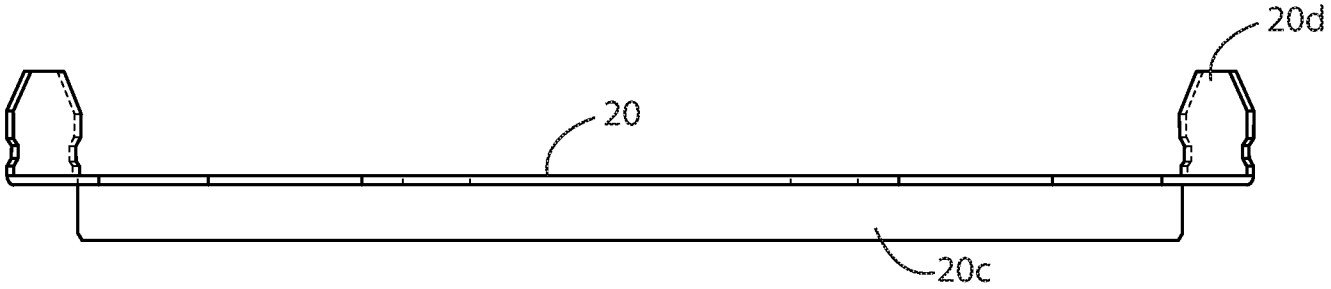
Figure 3D:
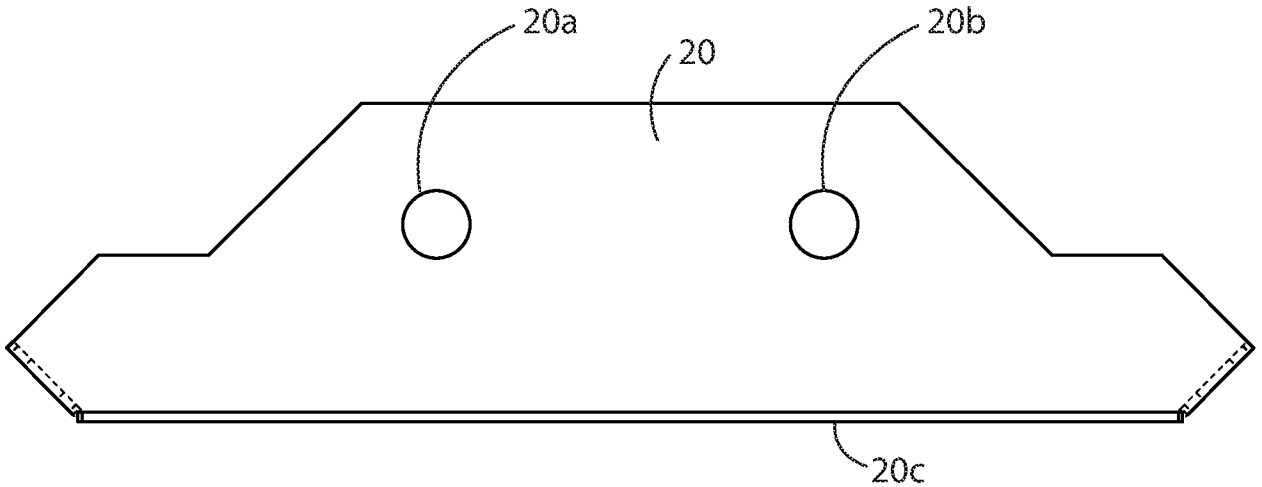
Figure 3E:
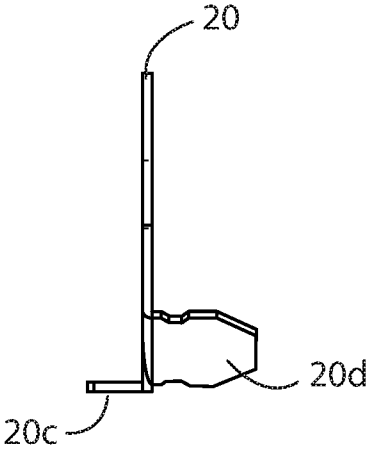
Figure 3F:
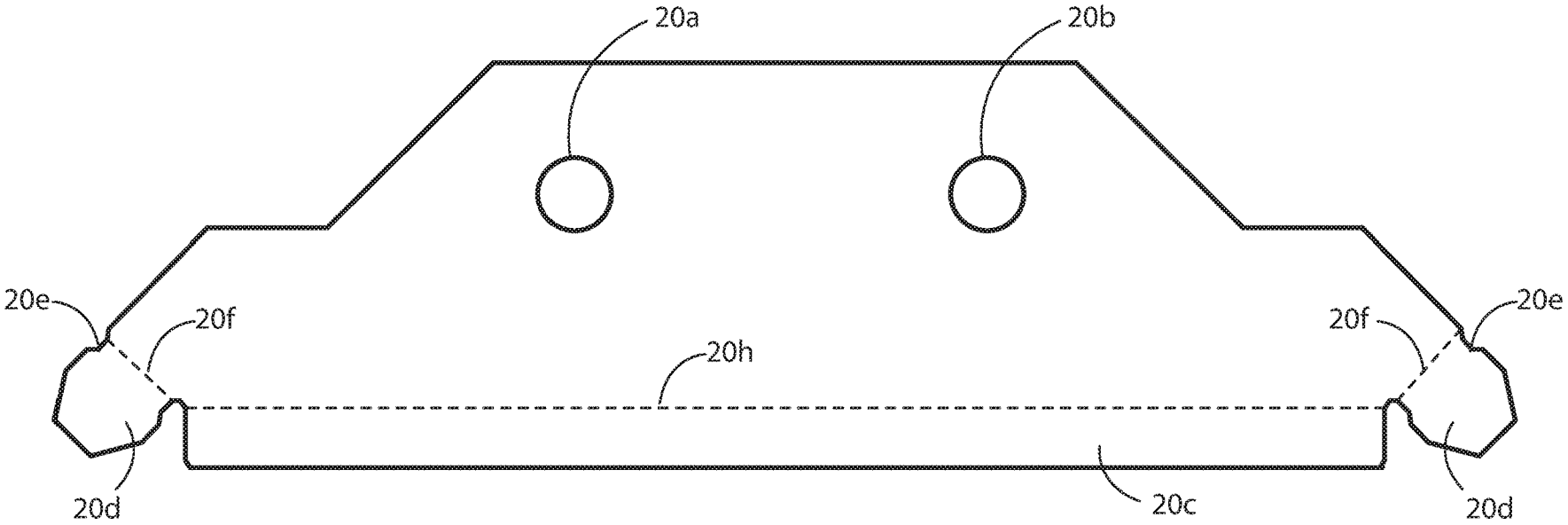

The embodiment of shield reinforcement plate of the present invention is fastened to each shield (9) on both sides from the outside of the chord, however, in a first embodiment (20), without the need for screwing, with fastening by flaps (20*d*) in grooves (RE) in chord (1), as shown in FIGS. 1B and 1C, avoiding the need for, in a second embodiment (21), the self-drilling screw shown in FIGS. 2A, 2B, and 2C.

The use of the self-drilling screw in the second embodiment of shield reinforcement plate (21) creates steel filings which, if not removed, may oxidize and corrode the plate where it is deposited. In addition, there are cases where the screw may not be placed because the diagonals (11) may leave no space for proper screwing by screwdriver.

The first embodiment of the reinforcement shield plate (20) may be formed by a galvanized steel plate, preferably of the same thickness of the chord.

Figure 4A:
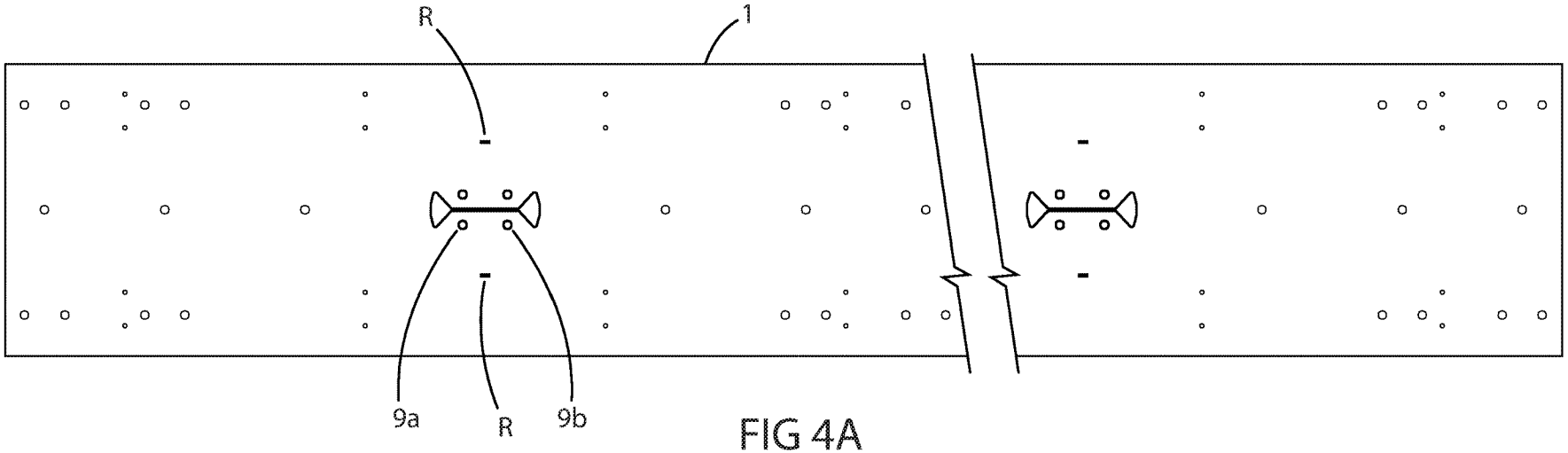
Figure 4B:
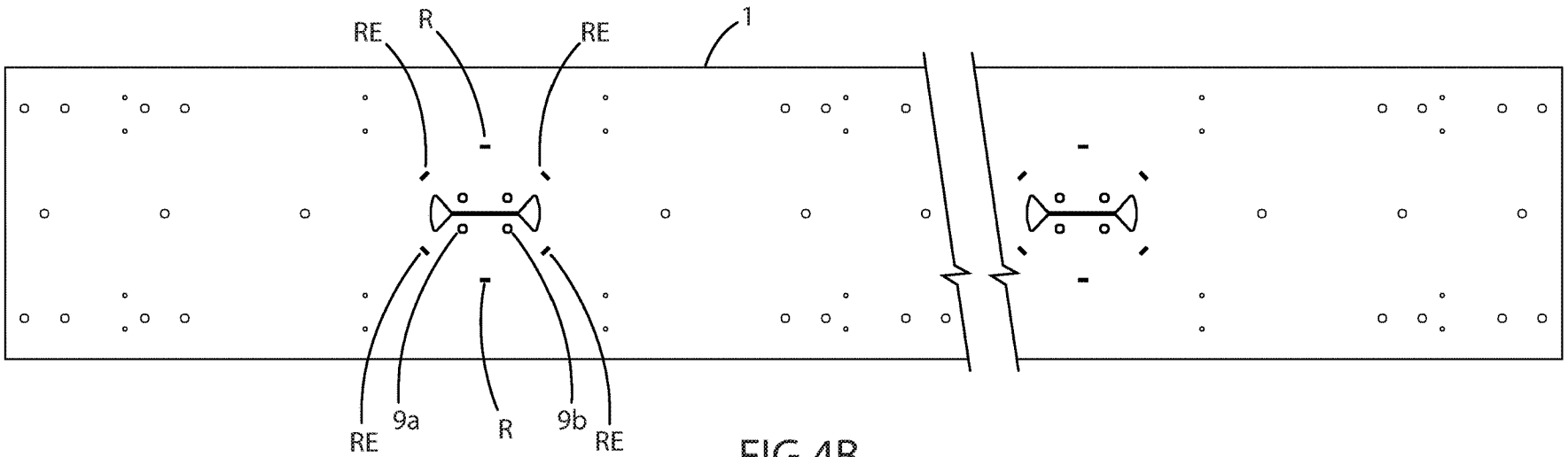
Figure 4C:
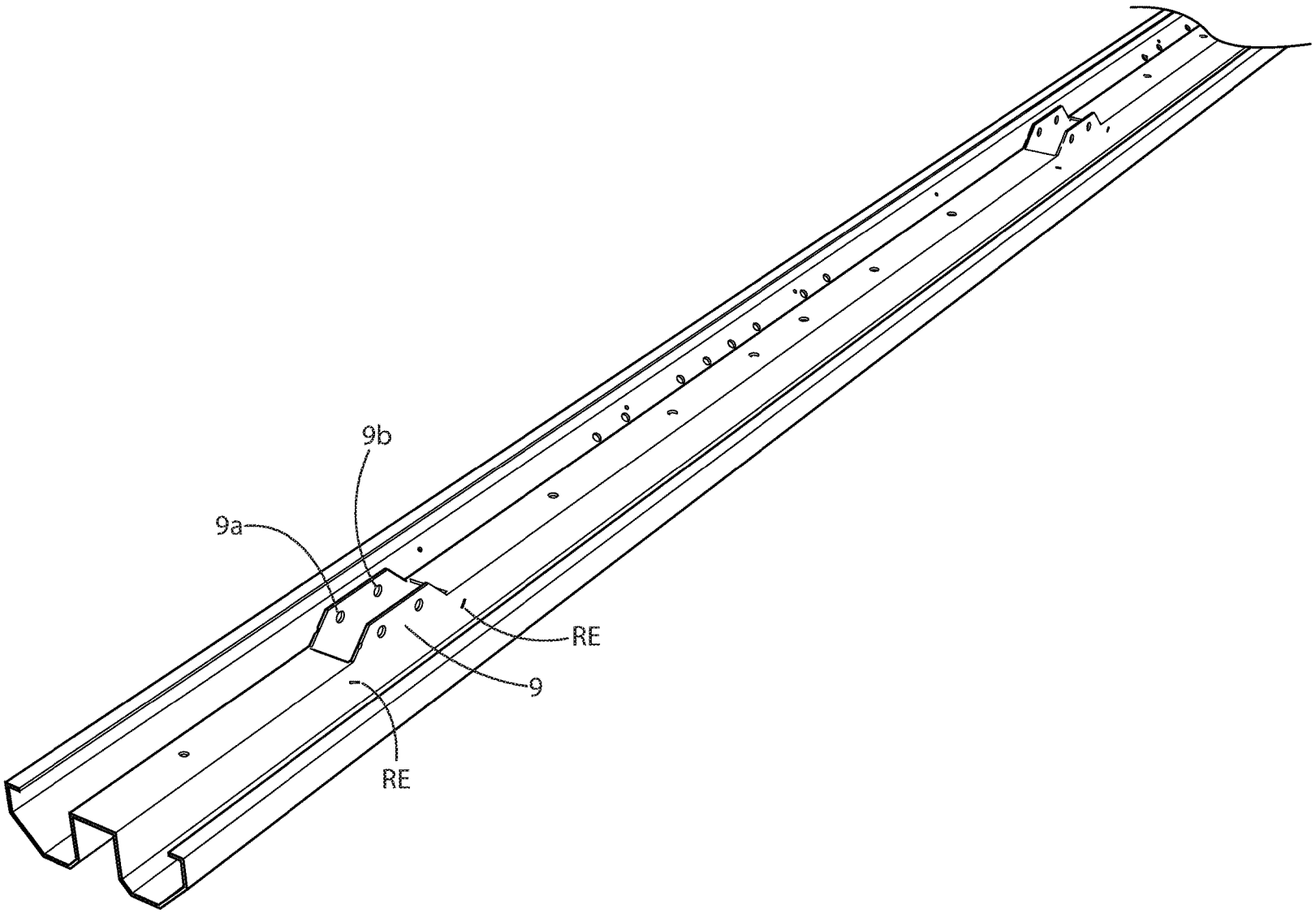
Figure 4D:
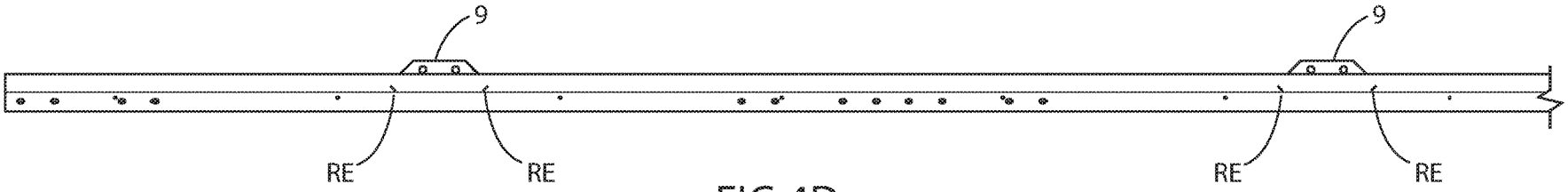
Figure 6A:
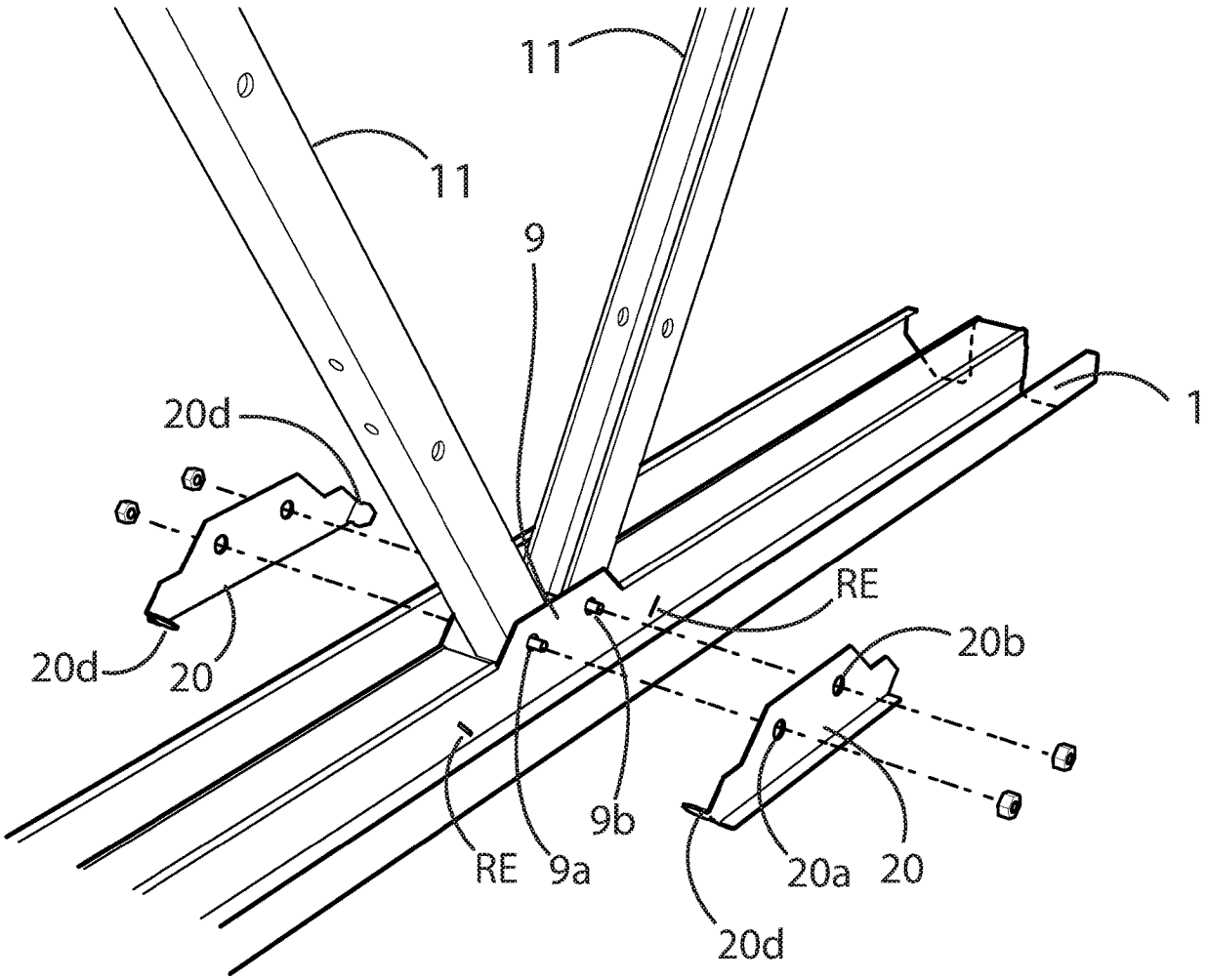
FIG. 6A is an exploded perspective view of a connection of two diagonals (11) to a shield (9) of a beam of the coverage structure illustrating the installation of shield reinforcement plates (20) in both sides of a shield (9) of the chord (1) and illustrating the alignment of reinforcement holes (20*a*, 20*b*) with shield holes (9*a*, 9*b*) and the groove (RE) in the chord for inserting the flaps (20*d*) of the shield reinforcement plates.
Figure 6B:
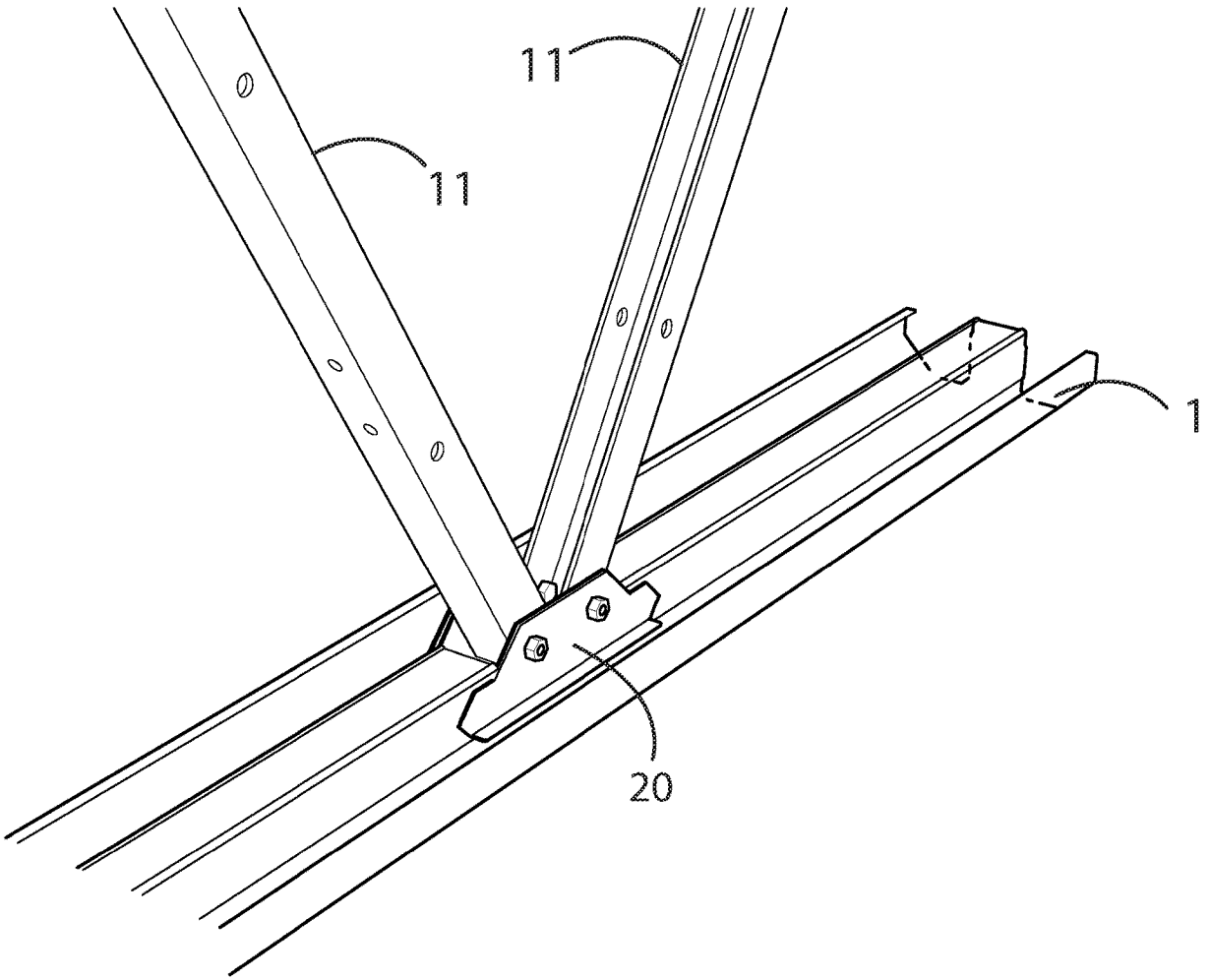
FIG. 6B is a perspective view showing the shield (9) with the reinforcement (20) already assembled.

The shield reinforcement plate (20) may include two holes for fastening with bolts (20*a* and 20*b*) and two small flaps (20*d*) inclined with respect to the chord, as shown in FIGS. 3A, 3B, 3C, 3D, 3E, and 3F. The small flaps (20*d*) may be inserted into grooves (RE) in the chord, specifically made for this purpose (see, FIGS. 4C, and 4D), as illustrated in FIGS. 6A, and 6B. The chord (1) may also be altered to receive the shield reinforcement plate (20) of the present invention, which can be seen comparing the developments of the existing chord (FIG. 4A) and the chord with the modification necessary to receive the new shield reinforcement plate (FIG. 4B). The modified chord having grooves (RE) around the shields to receive the flaps (20*d*) of the shield reinforcement plate (20).

Figure 5A:
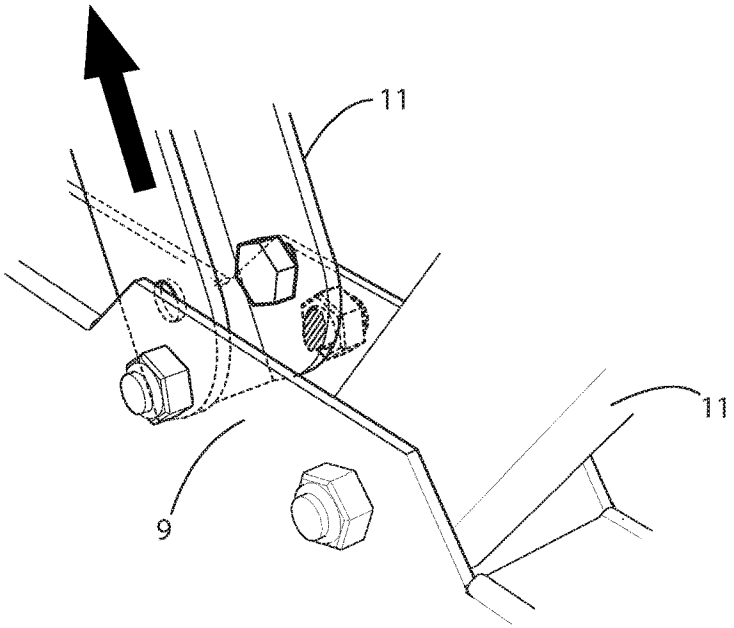
Figure 5C:
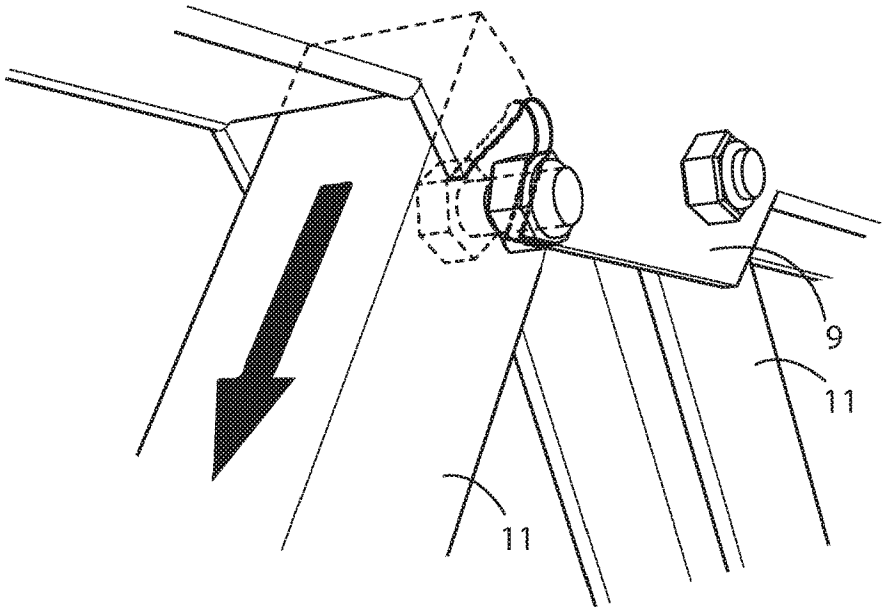
Figure 5B:
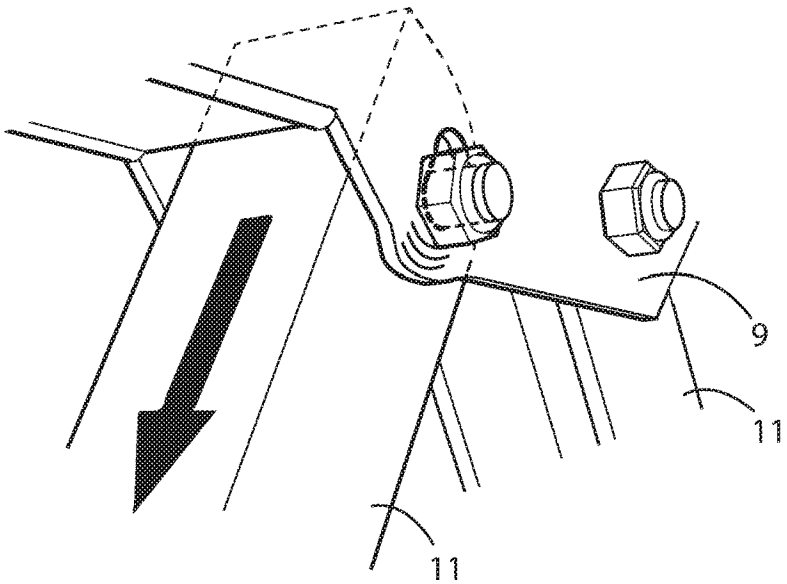
Figure 8:
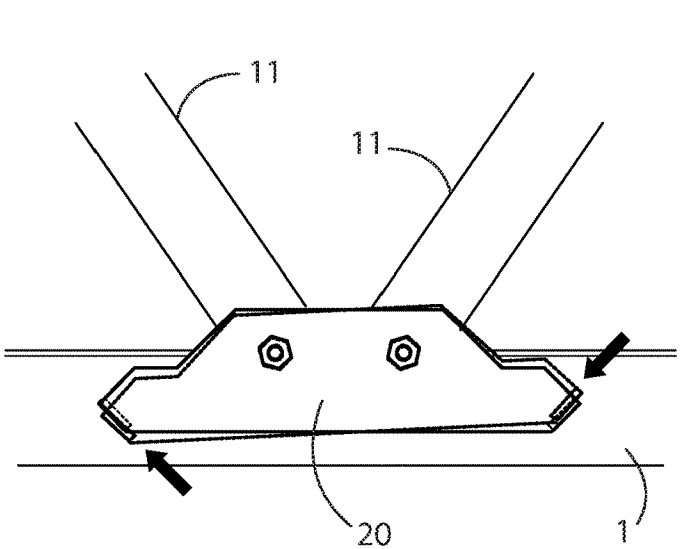
FIG. 8 schematically depicts a shield of chord (1) with shield reinforcement plate (20), illustrating the rotation of the shield reinforcement plate (20) imposed by the loads and prevented by the flaps (20*d*) of the shield reinforcement plate.

In both embodiments of the present invention, the thickness of the sheet in the bonding zone is increased, leaving it strengthened against crushing (FIG. 5B) and tearing (FIG. 5C), and avoiding rotation (FIG. 8).

The main difference between the first embodiment of shield reinforcement plate (20) and the second embodiment of shield reinforcement plate (21) resides in the fact that in the second embodiment of shield reinforcement plate (21) there is a self-drilling of the shield reinforcement plate (21) in the chord (1), in addition to the standard fastening, together with the diagonals, in the assembly of the structure. In the first embodiment of shield reinforcement plate (20) the overfastening occurs through the flaps (20*d*), the 90° stiffener (20*c*) stiffens the shield reinforcement plate (20) and the recesses (20*e*) all contribute to the synergy of the overall effect.

The shield reinforcement plate was developed for the initially disclosed system, based on the needs presented herein. This does not prevent the use of thicker plates both for shield reinforcement plate and diagonals to withstand higher loads. Thus, the standard chord is maintained, reinforcing only the necessary points (shields).

Various tests were carried out in the plant and in independent laboratories by the inventors.

In the plant tests, standard beams of the system initially developed were used. The beams were assembled on two supports, spanning a free span of 22.50 m, and on the shields closest to one of the supports were placed loads. Gradually, load was added in each point until reaching a connection collapse. In this way, connections were tested, without and with shield reinforcement plates, giving possibility to compare the results.

Figure 7:
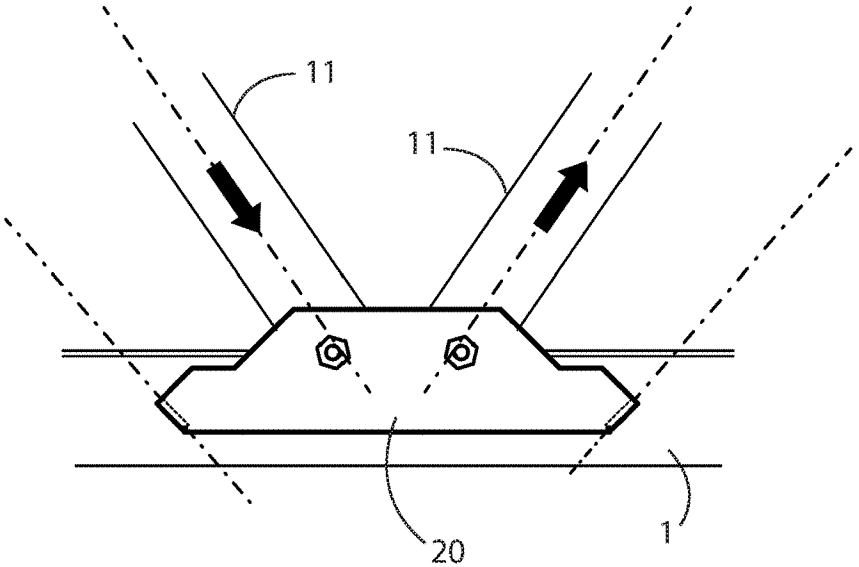
FIG. 7 schematically depicts a shield with a shield reinforcement plate (20) being subjected to compressive loads in the diagonal (11) to the left and traction in the diagonal (11) to the right.

Furthermore, in the plant tests it was found that the shield reinforcement plate geometry should also solve the fact that the shield reinforcement plate is deformed with the load stress. In most of the connections of the standard beams of the system initially revealed, one of the diagonals is compressed and the other is tensioned (FIG. 7). This causes a rotation in the shield reinforcement plate, aiding its deformation and its detachment from the chord (FIG. 8). In order to solve this problem, a stiffening was created at its edge through a fold in the plate (20*c*), in addition to providing its small recess (20*e*), which with the rotation of the shield reinforcement plate, fit into the plate of chord (FIGS. 3A, 3B, 3C, 3E, 3F,7 and 8).

In the laboratory tests, the tests were limited to tensioning test specimens also without and with the shield reinforcement plates. The test specimens were made in such a way as to reproduce the original situation of connecting the parts in the beam.

In this way, the data that comprise the table below were obtained, confirming the increase in resistance generated by the placement of the shield reinforcement plate.

The following table shows the main results obtained in tests carried out in specialized laboratory, approved by Inmetro, with the standard connection, connection with shield reinforcement plate and diagonal with thickness 1.95 mm and connection with shield reinforcement plate and diagonal with thickness 2.70 mm. The end of the assay was not determined by actual collapse, but by the continued decrease of the resistive force indicating the crushing of the bore and imminent collapse indicated in the column MAX STRENGTH FORCE in table below.

TABLE 1

| MODEL | PROPORTIONAL LIMIT FORCE (kgf) | YIELDING LIMIT FORCE (kgf) | MAX. STRENGTH FORCE (kgf) | COLLAPSE |
|---|---|---|---|---|
| 1 | 1,960 | 2,211 | 2,453 | NO |
| 1 | 1,801 | 1,990 | 2,357 | NO |
| 1 | 1,814 | 2,089 | 2,411 | NO |
| 2 | 2,397 | 2,629 | 3,453 | NO |
| 2 | 2,284 | 2,647 | 3,478 | NO |
| 2 | 2,373 | 2,721 | 3,202 | NO |
| 3 | 2,671 | 3,283 | 4,170 | NO |
| 3 | 2,526 | 3,187 | 4,432 | NO |
| 3 | 2,450 | 3,212 | 4,356 | NO |

Tested models:

1 - Standard - Chord with thickness of 1.55 mm, connection without shield reinforcement plate and diagonal with thickness of 1.55 mm.

2 - Chord with thickness of 1.55 mm, connection with shield reinforcement plate and diagonal with thickness of 1.95 mm.

3 - Chord with thickness of 1.55 mm, connection with shield reinforcement plate and diagonal with thickness of 2.70 mm.

From the above tests the conclusion by the enormous efficiency of the shield reinforcement plate is the maintenance of the integrity of the structure meeting its objective.

The Brazilian standard—NBR 14762—and American standards—AISI—allow a bolted connection to be dimensioned, based on laboratory test results. In this case, the laboratory must be suitable, with adequate and calibrated equipment, besides having professionals with proven experience in the preparation and performance of the tests.

The prototype to be tested, its assembly, the loading value and the manner of application of the load shall be consistent with the service conditions of the structure. In the tests, the applied actions corresponding to the last limit states established in each case are determined. The value of these actions is called the "nominal value of resistant stress". The calculated resistant stress is determined by the relation between the nominal value of the resistant stress and the weighting coefficient of resistance (γ), calculated by the formula:

$$\gamma = \frac{1}{1.52(XmXf)e^{-\beta 0\sqrt{\delta m^2+\delta f^2+Cp\delta t^2+0.044}}}$$

Where: (by table 17—Statistical data for determination of weighting coefficient of resistance—page 68 of NBR 14762)

Xm—1.10

Xf—1.00

$B_0$—3.5

δm—0.08

δf—0.05

δt—6.5%

Cp—5.7

$$\gamma = \frac{1}{1.52(1.10.1.00)e^{-3.5\sqrt{0.08^2+0.05^2+(5.7.0.065^2)+0.044}}} = 1.58$$

$$\gamma = 1.58$$

Model 1:

$$\text{Average model 1: } \frac{(2453+2357+2411)}{3} = 2{,}407 \text{ kgf}$$

$$\text{Calculated Resistant Stress: } \frac{2407}{1.58} = 1{,}523 \text{ kgf}$$

Model 2:

$$\text{Average model 2: } \frac{(3453+3478+3202)}{3} = 3{,}377 \text{ kgf}$$

$$\text{Calculated Resistant Stress: } \frac{3377}{1.58} = 2{,}137 \text{ kgf}$$

Model 3:

$$\text{Average model 3: } \frac{(4170+4432+4356)}{3} = 4{,}319 \text{ kgf}$$

$$\text{Calculated Resistant Stress: } \frac{4319}{1.58} = 2{,}734 \text{ kgf}$$

It is evident that the shield reinforcement plate greatly increases the ability of the connection to resist actions by transferring to the diagonal the sizing of the connection. The diagonal becomes the determining piece, because it is in it that it is observed the crushing of the hole, which is what limits the connection. In this way, the connection strength can be obtained through the formula of the Brazilian standard for Contact Pressure (hole crushing) of the diagonal.

$$Frd = \frac{\alpha e.d.t.fu}{\gamma}$$

Where,
Frd=Calculated resistant force to crushing
$\alpha_e$=(0.183.t)+1.53
d=screw diameter—⅜"≈9.50 mm
t=thickness of analyzed element
fu=rupture resistance of the steel of the analyzed element—400 MPa
γ=1.55

Thus, we will have following theoretical resistances:
Diagonal 1.55 mm:

$$Frd = \frac{1.81.9.50.1.55.400}{1.55} = 6{,}892 \text{ N}$$

As there are 2 screws in the connection: 6,892×2=13,784 N 1,378 kgf.
Diagonal 1.95 mm:

$$Frd = \frac{1.89.9.50.1.95.400}{1.55} = 9{,}035 \text{ N}$$

As there are 2 screws in the connection: 9,035×2=18,070 N 1,807 kgf.
Diagonal 2.70 mm:

$$Frd = \frac{2.02.9.50.2.70.400}{1.55} = 13{,}371 \text{ N}$$

As there are 2 screws in the connection: 13,371×2=26,742 N 2,674 kgf.

Comparing these theoretical values with those determined based on the tests, we can note that although they are close, the theoretical values are lower than the values of the chords with shield reinforcement plates found through tests.
Diagonal 1.55 mm: 1,378<1,523 kgf
Diagonal 1.95 mm: 1,807<2,137 kgf
Diagonal 2.70 mm: 2,674<2,734 kgf Thus, for checking the connection chord-diagonal, one must use the theoretical calculation of the diagonal, which, because it is numerically inferior, ensures a higher safety factor.

It was concluded from these results that:

Using the shield reinforcement plate increases the resistance of the bolted connections of the beams of the initially revealed system by about 90%.

With the shield reinforcement plate the connection strength is governed by the thickness of the diagonal connected to the chord. Thus, it is possible to limit the resistance of the bolted connection through the theoretical calculation of the crushing of the hole limit (contact pressure).

With higher thicknesses of shield reinforcement plates and diagonals connected to them, higher connection strength values can be achieved.

The beams whose sizing is driven by the connections have their resistance considerably increased, practically without changes in the total weight. With this, the cost of the structure and of the product as a whole, is practically unchanged.

DESCRIPTION OF THE ELEMENTS OF THE FIGURES

For a better understanding of the present invention, the following list of elements and/or components is presented:
1—chord
RE—groove in chord for new Shield reinforcement plate
3—structure (chords+diagonals+bridging angles)
9—shield
9*a*, 9*b*—Shield holes
11—diagonal
20—first embodiment of Shield reinforcement plate
20*a*, 20*b*—Holes of Shield reinforcement plate
20*c*—Stiffener (folding) of Shield reinforcement plate
20*d*—Flaps of Shield reinforcement plate
20*e*—Recesses in the bases of the flaps
20*f*—flap fold line
20*h*—folding line of stiffening in the base
21—Second embodiment of Shield reinforcement plate
21*a*, 21*b*—Holes of Shield reinforcement plate
21*c*—Holes of the flaps of Shield reinforcement plate
21*d*—Flaps of Shield reinforcement plate

DETAILED DESCRIPTION OF THE INVENTION

This item of improvement of shield reinforcement plate (20) in its above-described embodiment will be described in detail, with reference to the accompanying drawings, as follows.

The main object of the present invention comprises a part called a Shield reinforcement plate (20), with substantial improvements over the prior art, having various reflections in the coverage structure of the present invention.

The Shield reinforcement plate (20) includes a steel plate approximately 1 to 3 mm thick, shaped in a characteristic shape by a tool in a continuous process, comprising 2 (two) holes (20*a*, 20*b*), a pair of fins (20*d*), also called flaps and a fold (20*c*) bent at 90° relative to a base of the shield reinforcement plate (20). The fold (20*c*) is referred to as a stiffener.

The holes (20*a*, 20*b*) allow the shield reinforcement plate (20) to be connected to outer faces of the chords (1) in a region of the shields (9), aligned with existing holes (9*a*, 9*b*) and with holes of the diagonals (11) through which bolts are inserted which, attached to nuts, promote the connections of the beam.

The pair of flaps (20*d*), folded 90° with respect to the surface of the part, are inserted into the grooves (RE) of the chord (1), limiting the torsion of the shield reinforcement plate relative to its center, caused by the stresses from the diagonals (FIG. 8). The flaps have recesses (20*e*) in their bases, which anchor themselves to the shield plate, making it difficult for the flaps to move away from the chord, due to the deformation caused by the stresses in the reinforcement plate.

DETAILED DESCRIPTION OF EMBODIMENTS OF THE INVENTION

One embodiment of the present invention provides a shield reinforcement plate (20) which may promote a substantial increase (about 90%) in the strength of the connection of the diagonals to the chords. As the beam is often sized by these connections, the strength of the beams of the coverage system initially developed increases without a corresponding increase in weight of the structure.

The shield reinforcement plate of the present invention may be used at certain points, that is, only in shields whose diagonals involved receive tensile or compressive load greater than the strength of the connection without reinforcement, which occurs only in shields close to supports or zones of load concentration. It may not be necessary to use shield reinforcement plates on all the shields of a beam.

The shield reinforcement plate of the present invention may be easy to assemble and use screws already existing in the beam of the initially disclosed system in the case of the first embodiment.

The manufacture of the shield reinforcement plate may not require major investments, simply adapting new tools to the equipment already used in the plant.

The strength of the shields with reinforcements obtained in the laboratory tests may be numerically greater than the theoretical resistance of the diagonals in the connection obtained by the formulas mentioned above to determine the strengths of the beam connections according to the Brazilian standard NBR 14762:2010 or AISI S100:2016.

Thus, the determination of the strength of the beam connections, even with the shield reinforcement plates, may be very simple, being sufficient to use the theoretical formulas of general knowledge.

The invention claimed is:

1. A shield reinforcement plate comprising a sheet formed by a tool in a forming process, the sheet comprising two holes (20*a*, 20*b*), a pair of flaps (20*d*), and a fold (20*c*) at 90° relative to a base of the shield reinforcement plate, the two holes (20*a*, 20*b*) configured for connecting the shield reinforcement plate to outer faces of a chord (1) in a region of a shield (9) of the chord (1), the two holes (20*a*, 20*b*) aligning with holes (9*a*, 9*b*) of the chord (1) and holes of diagonals (11) of a structure and configured to receive bolts that are fastened with nuts for securing the shield reinforcement plate to the chord (1) and the diagonals (11) wherein the pair of flaps (20*d*), folded at 90° with respect to the base of the shield reinforcement plate are inserted into grooves (RE) of the chord (1).

2. A shield reinforcement plate comprising a sheet formed by a tool in a forming process, the sheet comprising two holes (20*a*, 20*b*), a pair of flaps (20*d*), and a fold (20*c*) at 90° relative to a base of the shield reinforcement plate, the two holes (20*a*, 20*b*) configured for connecting the shield reinforcement plate to outer faces of a chord (1) in a region of a shield (9) of the chord (1), the two holes (20*a*, 20*b*) aligning with holes (9*a*, 9*b*) of the chord (1) and holes of diagonals (11) of a structure and configured to receive bolts that are fastened with nuts for securing the shield reinforcement plate to the chord (1) and the diagonals (11), wherein said pair of flaps also have recesses (20*e*) in a base of the pair of flaps.

3. The shield reinforcement plate according to claim 1, wherein the sheet is a steel plate 1 to 3 mm thick.

* * * * *